United States Patent [19]

Hirsch

[11] 4,106,974

[45] Aug. 15, 1978

[54] FLYING SPLICE APPARATUS

[75] Inventor: John L. Hirsch, Sheboygan Falls, Wis.

[73] Assignee: Curt G. Joa, Inc., Sheboygan Falls, Wis.

[21] Appl. No.: 722,833

[22] Filed: Sep. 13, 1976

[51] Int. Cl.[2] ..... B65H 19/16

[52] U.S. Cl. ..... 156/504; 156/157; 156/507

[58] Field of Search ..... 156/504, 507, 157, 159, 156/270, 505, 506, 508; 242/58.1, 58.3, 58.4; 83/733

[56] References Cited

U.S. PATENT DOCUMENTS

| | | | |
|---|---|---|---|
| 3,061,220 | 10/1962 | Gagg et al. | 156/504 X |
| 3,841,944 | 10/1974 | Harris, Jr. | 156/159 X |
| 3,886,031 | 5/1975 | Taitel | 156/157 X |
| 3,939,031 | 2/1976 | Takimoto | 242/58.4 X |
| 4,010,911 | 3/1977 | Heitmann | 156/505 |

*Primary Examiner*—William A. Powell
*Assistant Examiner*—William H. Thrower
*Attorney, Agent, or Firm*—Joseph P. House, Jr.

[57] ABSTRACT

Flying splice apparatus and method for splicing the leading end of a new web of rolled web material to a running web. The running web is trained between two coacting rotors respectively provided with coacting web press jaws. When a splice is to be made, the rotors are turned concurrently through a cycle in which the jaws coact to press the leading end of the new web against the running web. The jaw on one rotor comprises a vacuum pad to releasably hold the leading margin of the new web thereagainst. A double-faced adhesive tape is applied to the opposite margin of the new web. The jaw on the other rotor comprises an anvil and when the rotors are cycled to coact, the adhesive tape on the leading edge of the new web is pressed against the running web and the anvil jaw to adhere said leading edge to the running web and strip it from the vacuum pad, thus effectuating the splice.

7 Claims, 5 Drawing Figures

Fig. 2
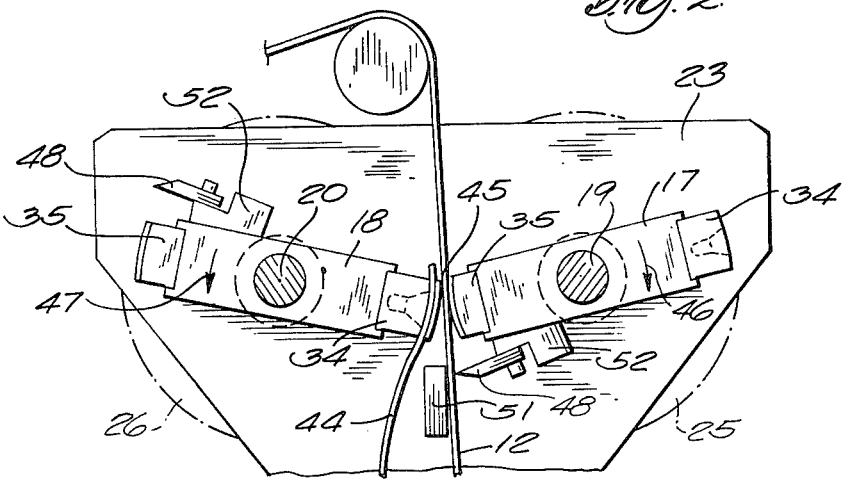
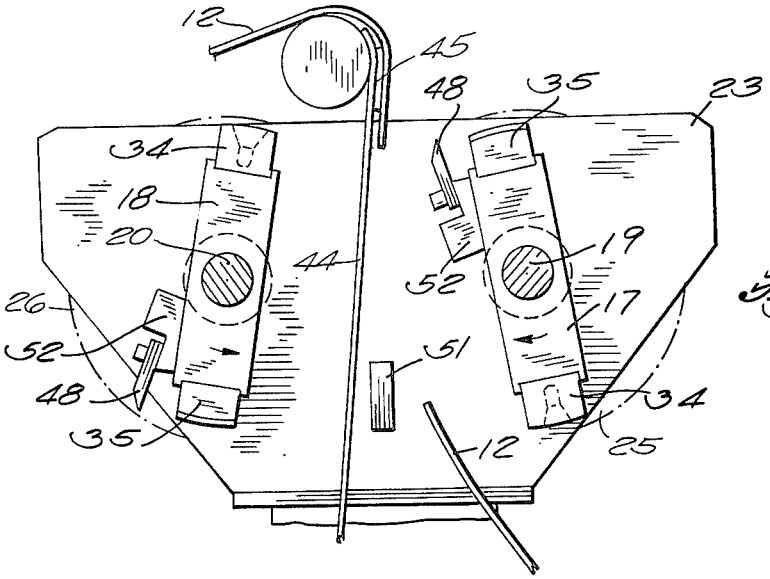
Fig. 3
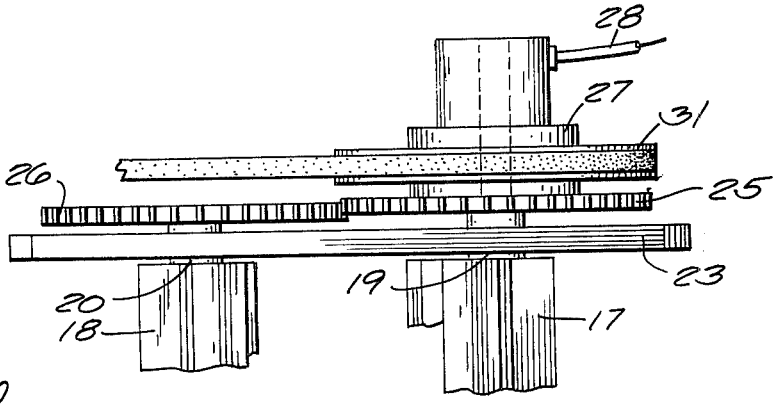
Fig. 4

FLYING SPLICE APPARATUS

BACKGROUND OF THE INVENTION

Although flying splices are commonly used in printing presses for newspapers and the like, I am not aware that they have been utilized commercially in the fabrication of sanitary pads, such as sanitary napkins, diapers, hospital pads, etc. The method and apparatus of this invention is specifically adapted to execute the flying splices between successive webs of non-woven fabric, plastic film such as polyethylene film or tissue which are incorporated in such pads in a continuous operation.

SUMMARY OF THE INVENTION

In accordance with the present invention, the running web is trained between two coacting rotors, each provided with one jaw of a pair of coacting web press jaws. The rotors are periodically turned in a cycle in which the jaws come together and coact to press the leading end of a new web against the running web. One of the jaws is provided with holding means such as a vacuum pad for releasably holding one side of the leading margin of the new web to the jaw. The opposite side of this leading margin is covered by a double-faced adhesive tape or other adhesive means. The jaw on the other rotor comprises an anvil jaw which desirably has a resilient face. To effectuate a splice, the rotors are concurrently turned to bring the jaws together, thus to press the exposed face of the adhesive tape against the running web and adhere the new web thereto. The vacuum is shut off thereby allowing the leading end of the new web to be stripped away from the vacuum pad. In preferred embodiments, knife or other severing means is mounted on the rotors to sever the running web behind the point where the splice is made.

In preferred embodiments, each rotor has both a holding jaw and an anvil jaw mounted in angularly spaced relationship about the axis of rotation of the rotor. The holding jaws and anvil jaws on the respective rotors are disposed in staggered relation for successive coaction of a holding jaw on one rotor with an anvil jaw on the other rotor. This allows the machine operator to alternate new rolls of webbing material on either side of the splicing apparatus.

Other objects, features and advantages of the invention will appear from the disclosure hereof.

DESCRIPTION OF THE DRAWINGS

FIG. 2 is a fragmentary diagrammatic view similar to FIG. 1 and showing the position of the rotors in the course of making a splice.

FIG. 3 is a view similar to FIG. 2, but showing the rotors in their position after they have completed a splice and in which the splicing apparatus is again at rest with respect to the spliced web.

FIG. 4 is a fragmentary plan view showing the drive mechanism by which the rotors are driven and controlled.

DESCRIPTION OF THE PREFERRED EMBODIMENTS

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Joa U.S. Pat. No. 3,666,611 of May 30, 1972, shows apparatus for fabricating sanitary pads, such as disposable diapers, in which parent rolls of non-woven fabric, plastic films such as polyethylene film or tissue are unwound from roll stands to form webs of sheet material at opposite sides of the pad. It is in such apparatus that the flying splice apparatus herein disclosed has particular utility.

Figure 1:
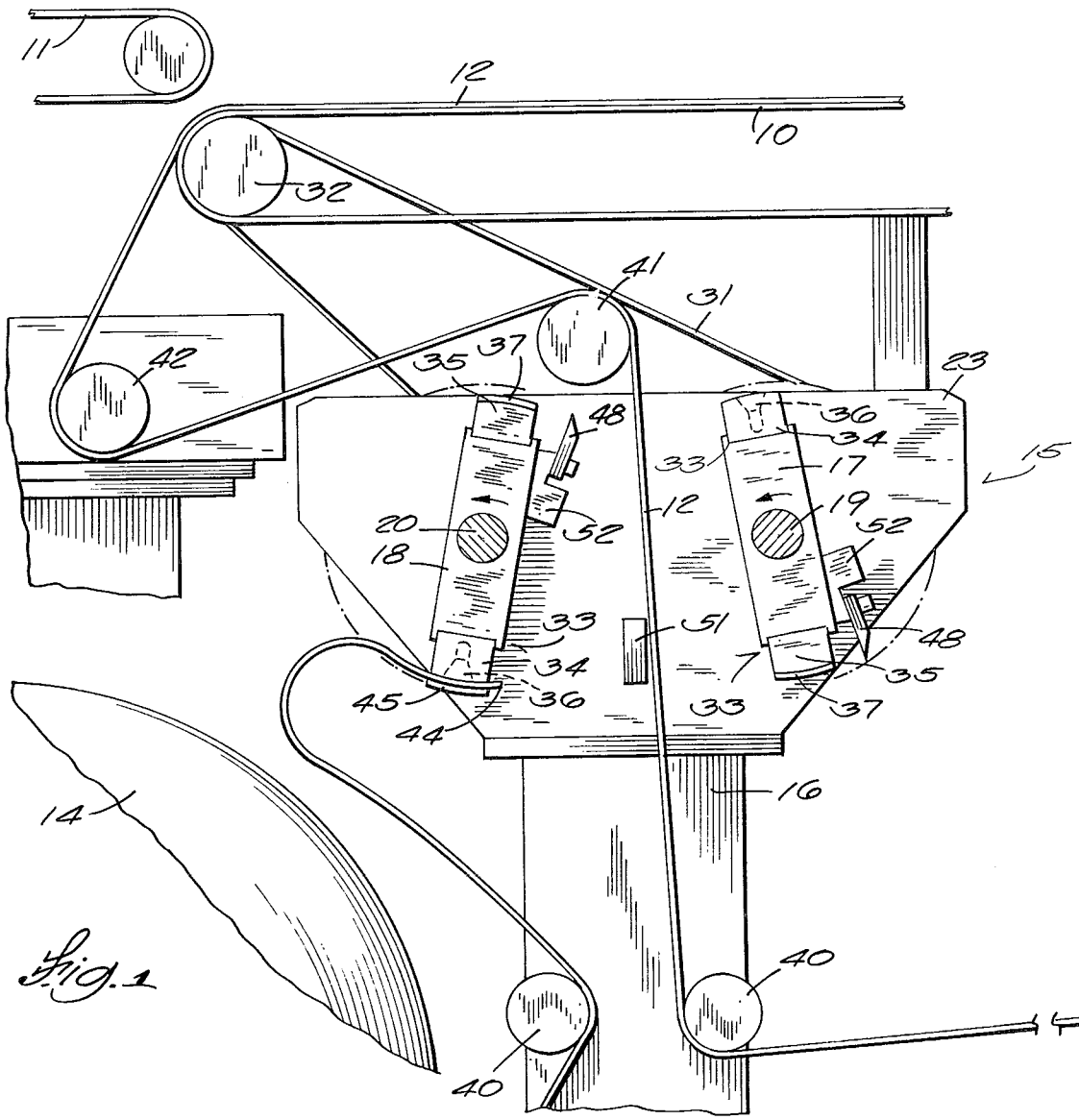
FIG. 1 is a diagrammatic side elevation of apparatus embodying the invention and showing the splicing apparatus at rest with respect to a running web, but in readiness for effectuating a splice.

FIG. 1 diagrammatically illustrates a conveyor belt 10 which carries sanitary pads fed thereto by infeed belt 11, in a manner similar to that illustrated in Joa U.S. Pat. No. 3,666,611. Such pads are deposited on a running web of nonwoven fabric or tissue 12. Running web 12 is unwound from a web roll 13 mounted on a roll stand 21. Roll 13 is driven by a surface drive belt 22. In course of time, web roll 13 will become nearly used up and it will be necessary to splice the leading edge of another web roll to the trailing end of running web 12, in order to continue pad fabrication operations. Heretofore in fabrication of such sanitary pads, it was necessary to stop the machine in order to make this splice manually.

In accordance with the present invention, a new full web roll 14 is mounted on another roll stand (not shown) near web roll 13. The flying splice apparatus 15 is mounted between the old roll 13 and the new roll 14, on a pedestal 16. Flying splice apparatus 15 comprises paired rotors 17, 18 mounted for rotation on their axle shafts 19, 20 on the side plates 23 of a frame which also includes cross rails 24.

As best shown in FIG. 4, the ends of rotor shafts 19, 20 are provided with meshing gears 25, 26. Gear 25 is driven by any suitable means under control of an electrical stepping clutch 27 which drives the gears 25, 26 periodically and in defined steps. Clutch 27 is controlled through control wires 28. In the illustrated embodiment, the drive to the gear 25 is by belt 31 trained around the end pulley or roller 32 which also supports the conveyor belt 10. Other suitable drive means could be substituted. In any event, the electric clutch 27 is controlled to periodically connect the drive 31 to the gear 25 and hence concurrently rotate both rotors 17, 18 in opposite directions of rotation to effectuate a splice as hereinafter described.

In the illustrated embodiment, each rotor 17, 18 comprises a skeletonized bar. This construction saves weight and still provides for internal vacuum passages. Each bar 17, 18 has its edges formed as a channel 33 which provides a mounting seat for a web pressing jaw. One edge of each bar 17, 18 carries a web holding jaw 34 and its opposite edge carries an anvil jaw 35.

Web holding jaws 34 in the preferred embodiment comprise vacuum pads having a series of spaced vacuum nozzles 36 communicating through suitable internal passages in the bars 17, 18 to a source of vacuum, not shown.

The anvil jaws 35 are desirably provided with rubber or like resilient face pads 37.

Figure 5:
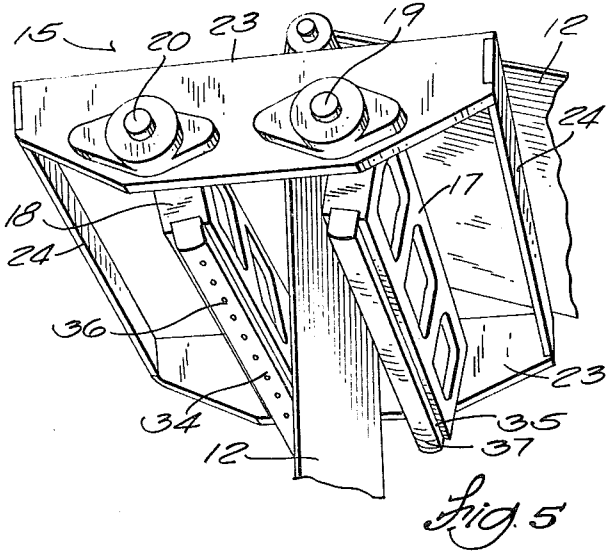
FIG. 5 is a bottom perspective view illustrating the apparatus of FIGS. 1, 2 and 3.

As shown in FIGS. 1 and 5, the two bar rotors 17, 18 are shown in rest position. Old web 12 is shown running between the rotors 17, 18 and is trained about guide rollers 40, 41, 42.

To prepare the apparatus for effectuating a splice, one side of the leading end margin of new web 44 on web roll 14 is laid against the vacuum pad 34 of rotor 18, as shown at the left side of FIG. 1. The pressure differential across the pad will releasably hold the web on the pad. A strip of double-faced adhesive tape 45 has previously been adhered to the opposite side of the web end margin which faces away from the vacuum pad 34. Accordingly, an adhesive surface of the tape 45 is exposed outwardly of the vacuum pad 34. Any other suitable adhesive may be used in lieu of the double-faced adhesive tape 45.

When the old web 12 is almost exhausted and it is time to splice the new web 44 thereto, clutch 27 is actuated, either manually or by conventional apparatus, such as a photo-electric cell sensor which detects when running web 12 is almost used up. In the illustrated embodiment, clutch 27 comprises a conventional one-half revolution clutch so that when triggered it will rotate both of the rotors 17, 18 through 180° or one-half of a full revolution. Upon such actuation, the rotors 17, 18 are rotated in the direction of arrows 46, 47 in FIG. 2, and at the same lineal speed as running web 12, thus to press web holding jaw 34 of rotor 18 against running web 12 and against anvil jaw 35 of rotor 17 as therein illustrated. In so doing, and in the position of the parts shown in FIG. 2, the exposed adhesive face of tape 45 is pressed against the side of running web 12. The vacuum to pad 34 is then shut off, allowing the adhesion of tape 45 to running web 12, to strip web 44 from vacuum pad 34 as the rotors 17, 18 continue their rotation to their position shown in FIG. 3 in which the rotors have come to another rest position.

In preferred embodiments, the rotors 17, 18 are also provided with web severing means, for example, knife blades 48, mounted by brackets 52 to rotors 17, 18 just behind the anvil pads 35 on both rotors. A fixed knife anvil bar 51 is mounted between the two rotors 17, 18 and has its ends fastened to the end plates 23 of the rotor frame. Accordingly, as the rotors 17, 18 sweep through their splicing position shown in FIG. 2, knife blade 48 coacts with the fixed anvil blade 51 to sever the running web 12 just behind the splice. The tail end of web 12 will then fall away as shown in FIG. 3.

After completion of the splice, the new web 44 now becomes the running web. Depleted web roll 13 is now removed from its roll stand 21 and is replaced by a fresh roll. In preparation for the next splice, the leading end of the fresh roll is then adhered by vacuum to the vacuum pad 34 of rotor 17 in its FIG. 3 position in the same manner as shown in FIG. 1, except that rotor 17 carries the leading end of the new web, instead of rotor 18. When the web 44 is nearly run out, another splice will be effectuated by again actuating the clutch 27 and the same technique illustrated in FIG. 2 will be repeated.

For the purpose of alternately splicing to running webs the leading ends of new web rolls on the two roll stands, the respective rotors 17, 18 each have both a vacuum pad jaw 34 and an anvil jaw 35, mounted on opposite edges of the rotors 17, 18. Accordingly, in the illustrated embodiment, clutch 27 advances each rotor through one-half revolution in each cycle. If desired, additional sets of vacuum jaws and anvil jaws could be provided on each rotor 17, 18. Such sets should be spaced angularly about the axis of rotation of the rotors through suitable arcs for coaction between suitable jaws on the respective rotors. In such event, the clutch 27 would be modified to rotate each rotor through the appropriate arc to effectuate a splice within the selected cycle. For example, if each rotor 17, 18 had four jaws, the clutch 27 would turn the rotors one-fourth revolution in each splicing cycle.

While the drawings illustrate splicing the web 12 fed to conveyor belt 10 from beneath, a similar flying splice apparatus is also provided to any web fed to the belt 10 from above.

What is claimed is:

1. Flying splice apparatus for splicing the leading end of a new web to a running web, said apparatus comprising two coacting rotors between which the running web is trained, said rotors being respectively provided with coacting web press jaws, means for rotating said rotors concurrently through a cycle in which said jaws coact to engage the leading end of the new web with the running web, one said jaw comprising a vacuum pad for temporarily holding one side of the leading margin of the new web to said one jaw, an adhesive strip on the other side of the leading margin of the new web and adhered thereto and having an exposed face, the other said jaw comprising an anvil jaw whereby coaction of the jaws will splice the said leading end of the new web to the running web by adhering the exposed face of the adhesive strip to the running web, continued rotation of said rotors through said cycle pulling said leading margin of the new web off of said vacuum pad, each said rotor being provided with both a vacuum pad jaw and an anvil jaw and means mounting said jaws in angularly spaced relation about the axis of rotation of the rotor for successive coaction of a vacuum pad jaw on one rotor with an anvil jaw on the other rotor in each said cycle.

2. Flying splice apparatus of claim 1 in which said adhesive strip comprises a strip of double-faced adhesive tape.

3. Flying splice apparatus of claim 1 in which said anveil jaw has a resilient face.

4. Flying splice apparatus of claim 1 in which said adhesive strip is spaced away from and out of contact with the vacuum pad by the intervening leading margin of the new web.

5. Flying splice apparatus of claim 1 in further combination with means for severing the running web behind the point thereon when the splice is made.

6. Flying splice apparatus of claim 5 in which one said means is mounted on each rotor behind one of said jaws.

7. Flying splice apparatus of claim 1 in which the means for rotating said rotors comprises a stepping clutch for advancing said rotors through said cycle.

* * * * *